US008590895B2

(12) United States Patent
Kwon

(10) Patent No.: US 8,590,895 B2
(45) Date of Patent: Nov. 26, 2013

(54) CARD GAME MACHINE

(76) Inventor: Dai Won Kwon, Busan-si (KR)

( * ) Notice: Subject to any disclaimer, the term of this patent is extended or adjusted under 35 U.S.C. 154(b) by 51 days.

(21) Appl. No.: 13/320,525

(22) PCT Filed: May 3, 2010

(86) PCT No.: PCT/KR2010/002792

§ 371 (c)(1),
(2), (4) Date: Nov. 14, 2011

(87) PCT Pub. No.: WO2010/131858

PCT Pub. Date: Nov. 18, 2010

(65) Prior Publication Data

US 2012/0061914 A1 Mar. 15, 2012

(30) Foreign Application Priority Data

May 12, 2009 (KR) ..... 10-2009-0041127

(51) Int. Cl.
*A63B 71/00* (2006.01)

(52) U.S. Cl.
USPC ..... 273/148 R

(58) Field of Classification Search
None
See application file for complete search history.

(56) References Cited

U.S. PATENT DOCUMENTS

| | | | | |
|---|---|---|---|---|
| 4,538,813 | A | 9/1985 | Pergeau | |
| 6,543,770 | B1 * | 4/2003 | Kaji et al. | 273/148 R |
| 8,152,617 | B2 * | 4/2012 | Katz | 463/13 |
| 8,248,462 | B2 * | 8/2012 | Peterka et al. | 348/54 |
| 8,282,478 | B2 * | 10/2012 | Lyons | 463/29 |
| 8,294,668 | B2 * | 10/2012 | Podoloff et al. | 345/156 |
| 8,313,367 | B2 * | 11/2012 | Hamlin | 463/16 |
| 8,328,628 | B2 * | 12/2012 | Kim | 463/25 |
| 8,348,740 | B2 * | 1/2013 | Katz | 463/13 |
| 8,357,041 | B1 * | 1/2013 | Saunders | 463/32 |
| 2009/0170595 | A1 * | 7/2009 | Walker | 463/25 |
| 2012/0100903 | A1 * | 4/2012 | Kwon | 463/16 |
| 2012/0309489 | A1 * | 12/2012 | Scott | 463/20 |
| 2012/0309503 | A1 * | 12/2012 | Scott | 463/25 |

FOREIGN PATENT DOCUMENTS

| | | | |
|---|---|---|---|
| JP | 2001-087448 | A | 4/2001 |
| JP | 2005-103243 | A | 4/2005 |
| JP | 2008-012157 | A | 1/2008 |
| KR | 2006-0093694 | A | 8/2006 |

OTHER PUBLICATIONS

Written Opinion dated Jan. 21, 2011 of PCT/KR2010/002792 which is the parent application and English translation—7 pages.
International Search Report dated May 3, 2010 of PCT/KR2010/002792 which is the parent application and English translation—5 pages.

* cited by examiner

*Primary Examiner* — Kurt Fernstrom
*Assistant Examiner* — Dolores Collins
(74) *Attorney, Agent, or Firm* — Knobbe Martens Olson & Bear LLP

(57) ABSTRACT

A card game machine enables players to play a card game using cards, each of which has a distinctive surface and a non-distinctive surface. The card game apparatus includes a card slide housing, a card stop unit, a card drive unit and a card receive unit. The card slide housing has slides, each of which is inclined such that cards and slide down. The card stop unit is coupled to the card slide housing to temporarily stop cards. The card drive unit causes the stopped cards to start sliding again. The card receive unit is arranged below the card stop unit and has a plurality of card receiving parts corresponding to the respective slides to receive cards. The card receiving parts are movable such that portions of the distinctive surfaces of the cards received in each receiving part are spaced apart from each other in one direction.

9 Claims, 13 Drawing Sheets

CARD GAME MACHINE

TECHNICAL FIELD

The present invention relates to a card game machine more particularly, to a card game machine with which card games such as Blackjack, poker etc. can be played without a card dealer.

BACKGROUND ART

Playing cards such as Hwatu cards, trump cards etc. are widely used in various games. Card game machines with which card games can be played without card dealer are disclosed in Japanese patent application publication 2008-12157, 2005-103243 and Korean patent application publication 2006-93694.

In the card game machines disclosed in the above publications, when plural cards supplied to players are stacked on a card table, distinctive surfaces of lower cards are covered by upper cards except a card at the top of a stack of cards. In the game where the distinctive information of all the stacked cards is used to play games, players need to memorize the distinctive information of the lower cards, so it is very inconvenient to play games with the prior card game machines. For example, in a card game machine illustrated in FIG. 8, trump cards are stacked on a card table disposed below sliders, so that players can see distinctive information of a card only until another card slides down the slider to cover the distinctive information of a lower card.

DISCLOSURE

Technical Problem

The prior card game machines distributing cards without a card dealer have problems that players cannot see the distinctive information of all cards distributed by the machines during a card game. The problems make it hard to enjoy the game.

The present invention is devised to solve the problems mentioned above. It is an object of the present invention to provide a card game machine that can distribute cards without a card dealer. And the machine can distribute cards in a state that the distinctive information of cards can be seen by players during a card game.

Technical Solution

According to the present invention, a card game machine for playing a card game with a plurality of cards, each of which has a distinctive surface and a non-distinctive surface, the card game machine comprising: a card slide housing having a plurality of slides, each of which is inclined with respect to the vertical direction such that cards can slide down each of the slides, and which are separated from each other; a card stop unit which is coupled to the card slide housing to stop cards from sliding down each of the slides at a predetermined position; a card distribute unit which distributes cards onto each of the slides; a card drive unit which causes the cards that have been stopped by the card stop unit to start sliding again down the slides on which they have stopped; and a card receive unit which is arranged below the card stop unit and which has a plurality of card receiving parts corresponding to the respective slides to receive the plurality of cards which have slid down the respective slides, wherein said plurality of card receiving parts are movable such that portions of the distinctive surfaces of the cards received in each receiving part are spaced apart from each other in one direction is provided.

Advantageous Effects

The card game machine of the present invention enables players to play a game without a card dealer, and enables distinctive information of each of the cards to be exposed always.

BEST MODES FOR CARRYING OUT THE INVENTION

Figure 1:
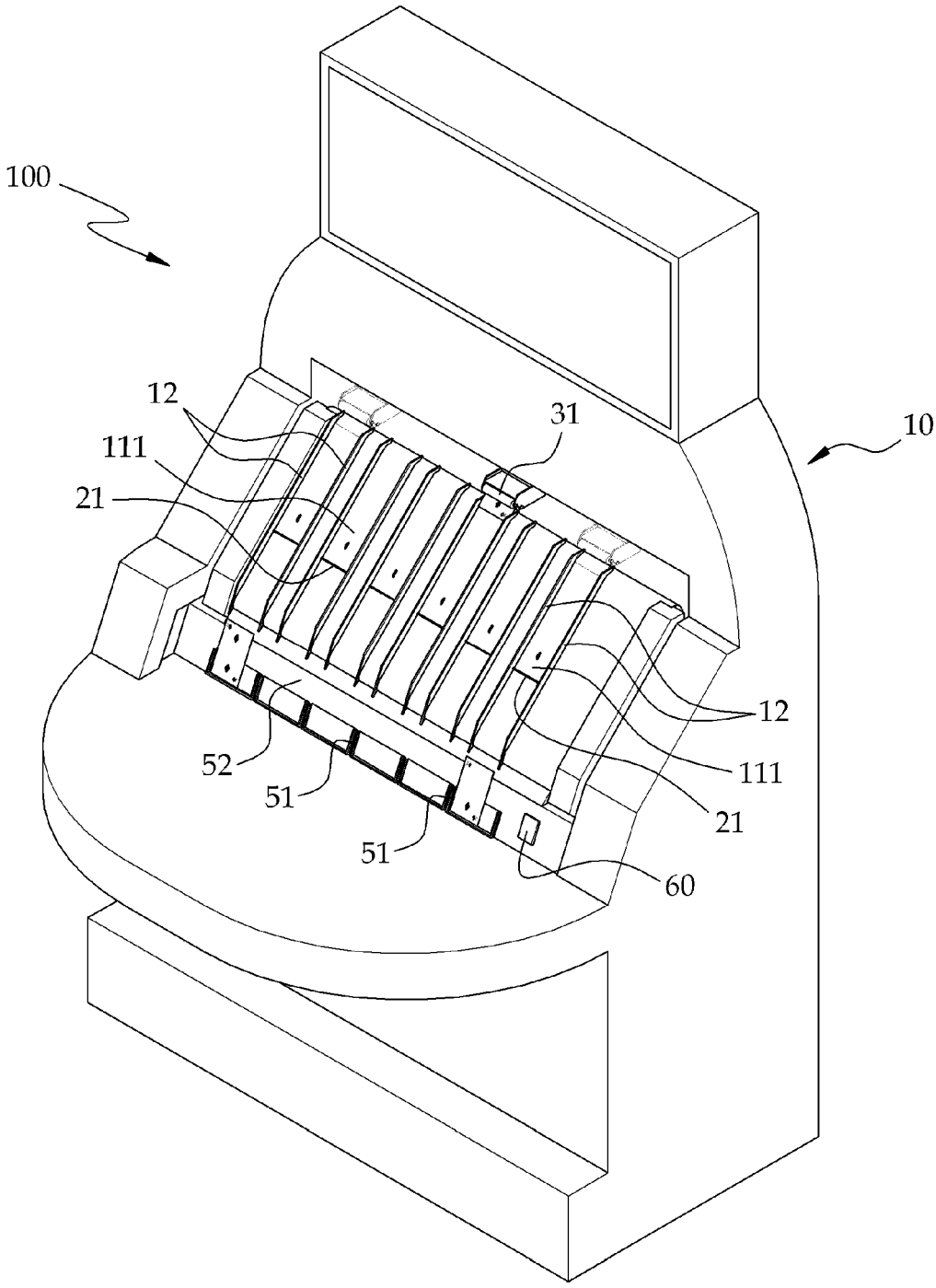
FIG. 1 is a perspective view of an embodiment of a card game machine according to the present invention.
Figure 2:
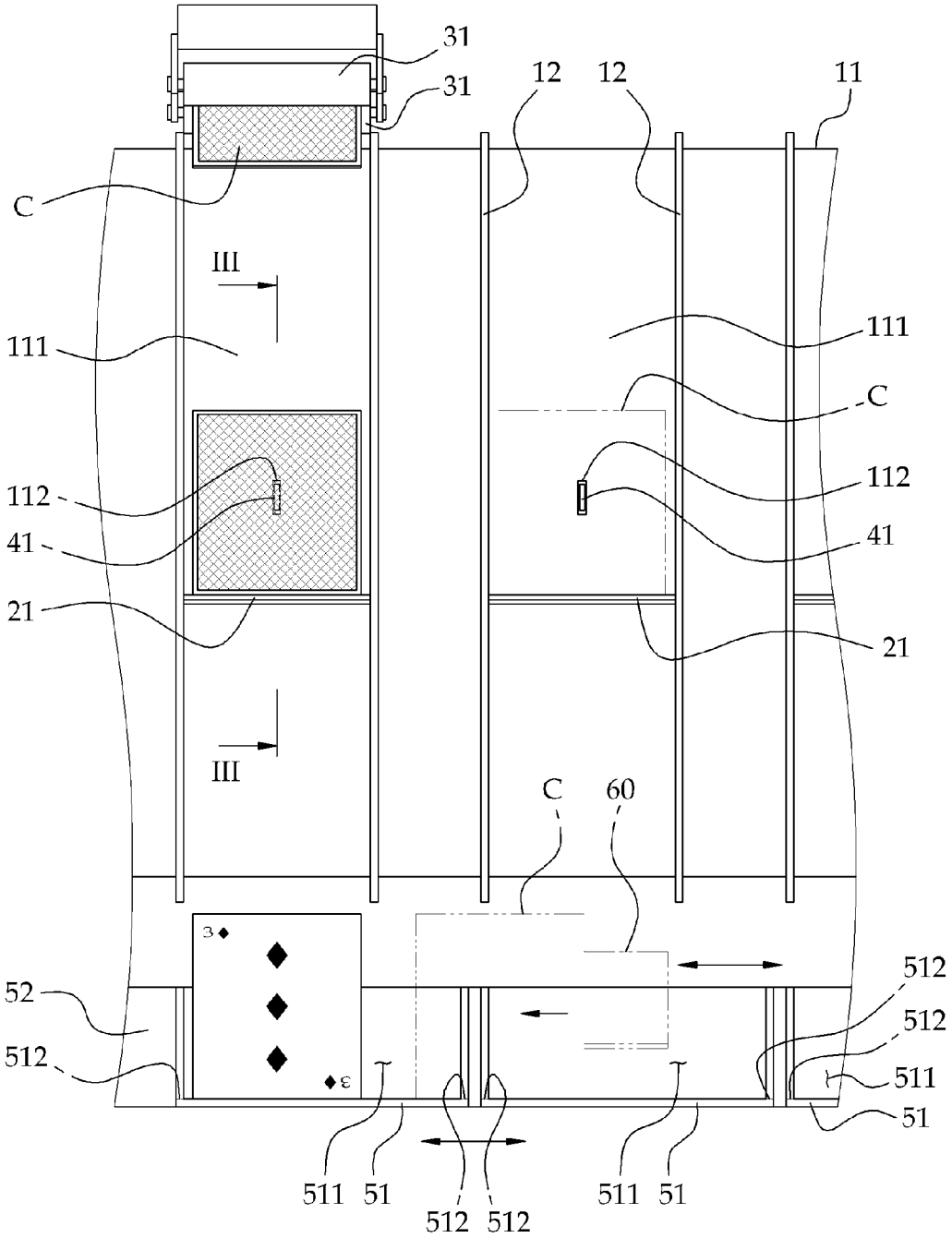
FIG. 2 is a partial front view of the card slide housing illustrated in FIG. 1.
Figure 3:
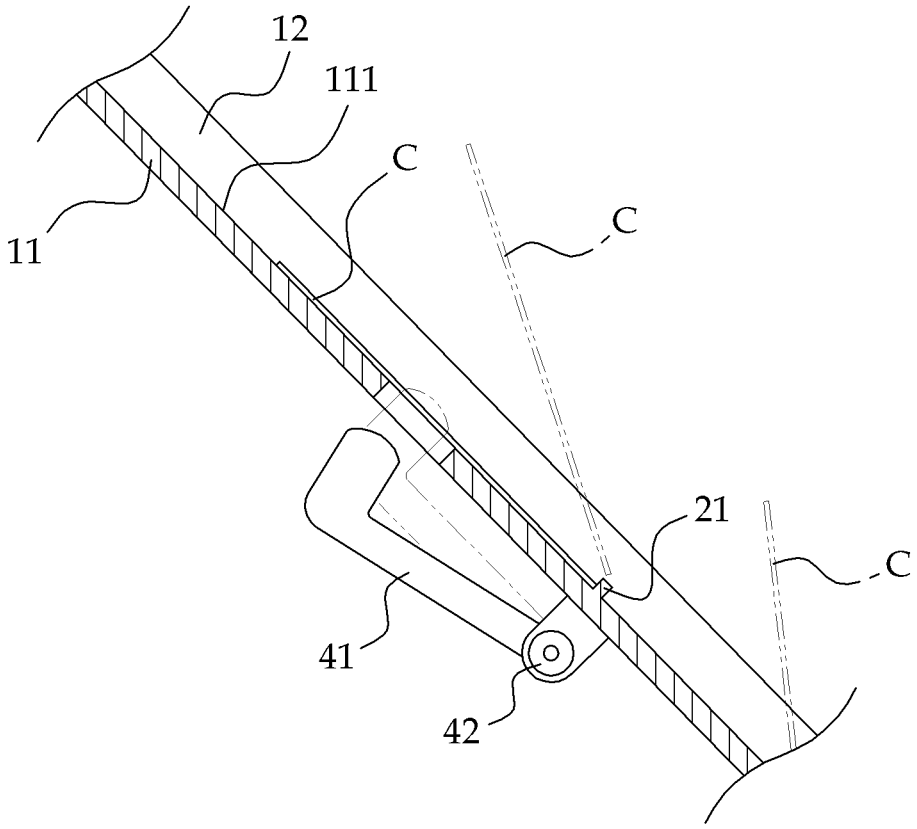
FIG. 3 is a cross-sectional diagram along line III-III of FIG. 2.
Figure 4:
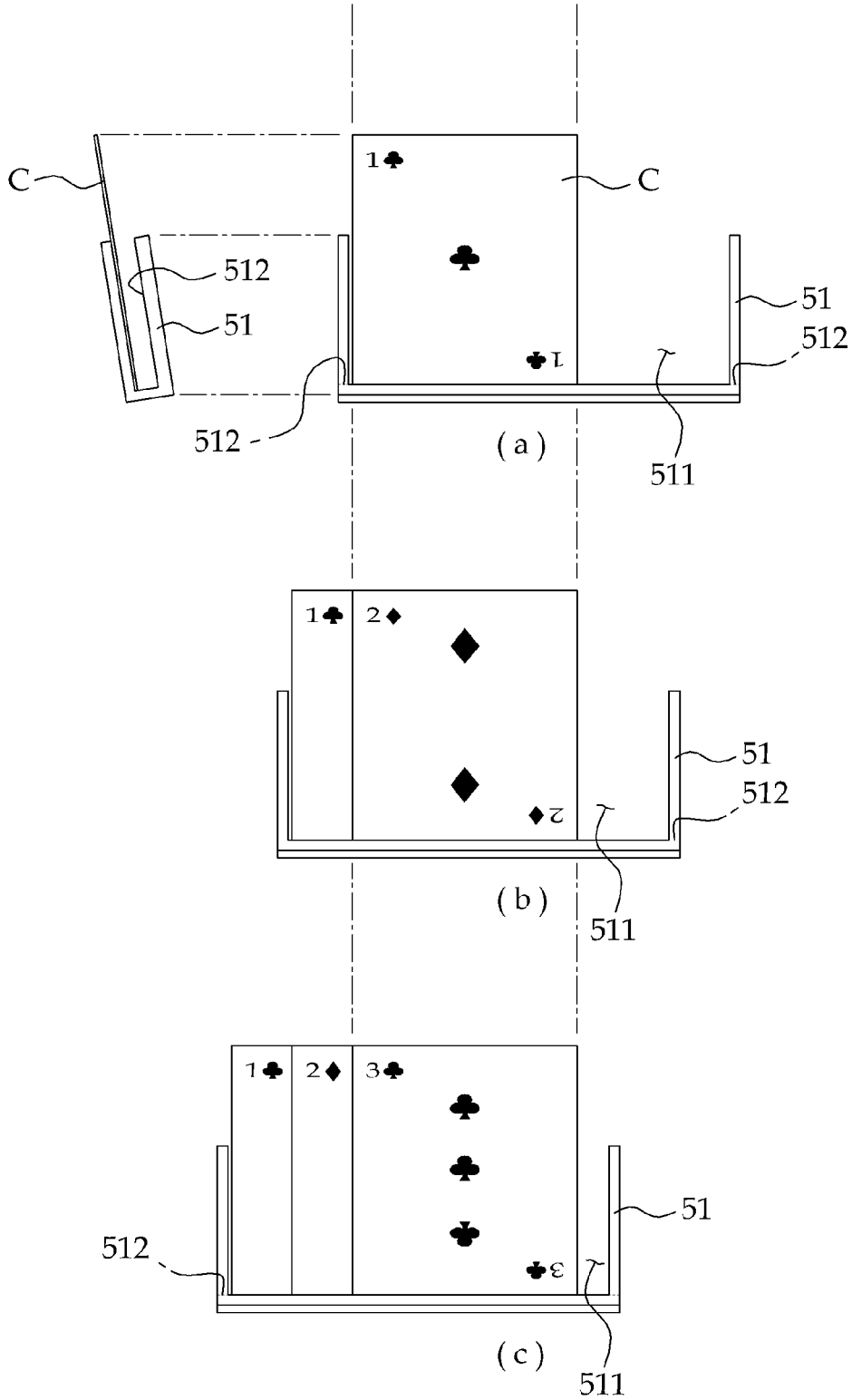
FIG. 4 illustrates the card receive unit in FIG. 2 in which a plurality of cards are stacked in a state that a portion of distinctive surface of each of cards is recognizable.

FIG. 1 is a perspective view of an embodiment of a card game machine according to the present invention. FIG. 2 is a partial front view of the card slide housing illustrated in FIG. 1. FIG. 3 is a cross-sectional diagram along line III-III of FIG. 2. FIG. 4 illustrates the card receive unit in FIG. 2 in which a plurality of cards are stacked in a state that a portion of distinctive surface of each of cards is recognizable.

Referring to FIGS. 1 to 4, card game machine 100 according to this embodiment is used to play card games such as Blackjack, Baccarat, Poker with cards C. Each card has a distinctive surface with distinctive information and a non-distinctive surface without distinctive information. The distinctive surface has distinctive information such as numbers, suits printed on the surface and the non-distinctive surface has common design and no distinctive information. In this embodiment, trump cards are used as playing cards.

The card game machine 100 has a card slide housing 10, a card stop unit, a card distribute unit, a card drive unit, a card receive unit.

The card slide housing 10 makes the exterior of the card game machine 100. The card slide housing 10 includes sliding plate 11. The sliding plate 11 is in the form of plate and is inclined in the vertical direction. The sliding plate 11 is divided into plural slides 111 by plural dividing walls 12 formed on the sliding plate 11 on either side of each slide 111. The dividing walls define the slide 111. Pairs of dividing walls 12 on either side of slides 111 are parallel to each other and are at a distance longer than the width of the cards C, so that when a card C is placed at the upper side of the slide 111, the card C slide down the slide 111 automatically. The number of the slides 111 can be properly determined. The larger the number of the slides is the more players can play card games with the card game machine 100. The slides are parallel to each other and displaced at a pre-determined distance. Plural holes 112 are formed through the sliding plate 11 and the number of the holes 112 is equal to the number of slides 111.

The card stop unit is installed to stop cards C which are sliding down the slides 111 at the pre-determined position. The card stop unit includes stoppers 21. Each stopper 21 can be formed at each slide 111 or attached to each slide 111 as separate component. The stoppers 21 are disposed below holes 112 at the same level and protrude from the slides 111. Each of the stoppers 21 contacts with a card which slides down, especially with the bottom of the card, so that each of the stoppers 21 stops the card at the pre-determined position. The cards are distributed the distinctive surfaces down by the card distribute unit not to reveal the distinctive information of the cards.

The card distribute unit distributes the cards to each of the slides 111 so that the cards can slide down each of the slides 111. The card distribute unit installed above the slides 111 and is movable in the horizontal direction. The card distribute unit distributes a card to one of the slides selectively during moving in the horizontal direction. The card distribute unit distributes the cards stacked in a cassette one by one. The card distribute unit can be a robot run by motors or actuators or can have the mechanisms disclosed in the prior arts of Japanese patent application publication 2008-12157, 2005-103243 and Korean patent application publication 2006-93694. For example a pair of rollers illustrated in FIGS. 1 and 2 through which cards come out can be used as a card distribute unit.

The card drive unit causes the cards stopped by the stoppers 21 to start sliding down again. The card drive unit has card reversing members 41 and driving units to drive the card reversing members 41.

The number of the card reversing members 41 is equal to the number of the driving units and the number of the card reversing member 41 is equal to the number of the holes 112. Each of the card reversing members 41 is rotatable around the pivot axis 42 engaged at the card slide housing 10. When the card reversing member 41 rotates around the pivot axis 42, the end of the card reversing member 41 is extruded through the hole 112. The end of the card reversing member 41 moves between extruding position as shown in imaginary lines in FIG. 3 and recessing position as shown in solid lines in FIG. 3. The card reversing member 41 is at the recessing position when the card C is supported by the stopper 21. When the card reversing member 41 moves to the extruding position to make the card C slide down, the end of the card reversing member 41 presses the card and the card is flipped over to expose the distinctive surface of the card and slides down the slide 111.

The driving unit is a motor to rotate the card reversing member 41. The driving unit can have a fluid power actuator and links to change linear driving force of the actuator to circular driving force.

The card receive unit is installed to receive cards which have slid down the slide. The card receive unit has plural card receiving housings 51 and a moving member 52 engaged with the receiving housings 51.

The number of the card receiving housings 51 is equal to the number of the slides 111. Each of the card receiving housings 51 is disposed below each of the slides 111. The upper side and the front side of each of the card receiving housings 51 are open. And a card receiving part 511 is formed at each of the card receiving housings 51. The card receiving part 511 is a space surrounded by the inner surfaces of the card receiving housing 51. The card which has slid down the slide 111 in a flipped over state is received in the receiving part. The card receiving part receives a card C through the upper side opening and the distinctive information of the card is visible through the front side opening. The card receiving housing 51 is wider than the slide 111. And the card receiving housing 51 has entrance holes 512 at the left and right sides. And the upper sides of the entrance holes are open.

The moving member 52 has a form of plate. The moving member 52 is engaged with the card receiving housings 51. The moving member 52 is installed to move horizontally. The means to drive the moving member 52 can be a stage in a lineal movement driven by an actuator or a motor.

And the card distribute unit, the card drive unit, the card receive unit are controlled by a controller and card game players can control each of the units by the controller. Thus, the card game players can enjoy a game in an active role by controlling the units.

In this embodiment, the moving member 52 is horizontally movable, so that the distinctive information of the plural cards sliding down each of the slides 511 and stacked in each of the card receiving parts 511 are recognizable unlike the prior arts. Referring to FIG. 4, this effect will be described below. In FIG. 4, only one card receiving housing 51 is shown and other components are removed to simplify the figure. (a), (b) and (c) steps in FIG. 4 show positions of the card receiving housing 51 in operation sequence and the arrangements of the cards received in the card receiving housing 51 at each of the positions.

Before starting a card game, the moving member 52 and the card receiving housing 51 are in the position shown in FIGS. 1 and 2. And if three cards are needed to decide the winner of the card game, card game player receives three cards through the (a), (b) and (c) steps shown in FIG. 4. Other players receive cards through the same steps.

Firstly, a player operates the card distribute unit to distribute a card C to one of slides 111. When the card is distributed to one of the slides 111, the card slides down the slide 111 until the card is stopped by the stopper in the state that the distinctive surface of the card is down. Thereafter, when the card reversing member 41 is operated automatically or manually, the card reversing member 41 is extruded out of the slide 111 through the hole and the card is flipped over by the card reversing member 41 to show the distinctive surface of the card and the card slides down the slide into the card receiving part 511 of the card receiving housing as shown in FIG. 4.

In this state that the card C is received in the card receiving part 511, the moving means is moved a little to the left side by a motor or an actuator, before the second card is received in the card receiving part 511. At this time, it is preferable that the displacement of the moving means 52 is set to allow the distinctive information printed edge of the trump card to be recognizable as shown in the (b) step of the FIG. 4.

In this state that the moving means 52 has moved to the left side, the second card can be received in the card receiving part 511 again through the same processes in a flipped over state. At this time, the second card partially covers the first received card to show the distinctive information of the first received card as shown in the step (b) of the FIG. 4.

And to receive the third card, the preceding processes are repeated and the third card is received as shown in the step (c) of the FIG. 4. At this time, three cards are partially overlapped, so that the distinctive information of each of three cards is recognizable. It is shown in the (a), (b) and (c) steps of FIG. 4 that each of the cards drops through the space between imaginary lines.

In the present embodiment, the card game machine enables card game players to always recognize the distinctive information of cards C received in the card receiving part 511 during the game, so that the card game players can enjoy the game conveniently.

In the meantime, the card game machine 100 of the present embodiment further comprises a card collect member 60. The card collect member 60 has rectangular shape slightly larger than a card C and moves relative to the moving means 52. Before collecting cards, the card collect member 60 is located on the right of slide 111 which is farthest to the right. And after a card game is over, the card collect member 60 goes through the entrance holes 512 to the left of slide 111 which farthest to the left, while the card collect member 60 pushes cards held in each of the card receiving parts 511 to the left of slide 111 which is farthest to the left. And the cards pushed to the left of slide 111 which is farthest to the left are collected in a collecting box disposed under the moving means 52. The card collect member 60 can have similar mechanism with the moving means 52. Also, the card collect member 60 can have the mechanisms disclosed in the prior arts of Japanese patent application publication 2008-12157, 2005-103243 and Korean patent application publication 2006-93694. Cards collecting process is illustrated in imaginary lines in FIG. 2.

Figure 5:
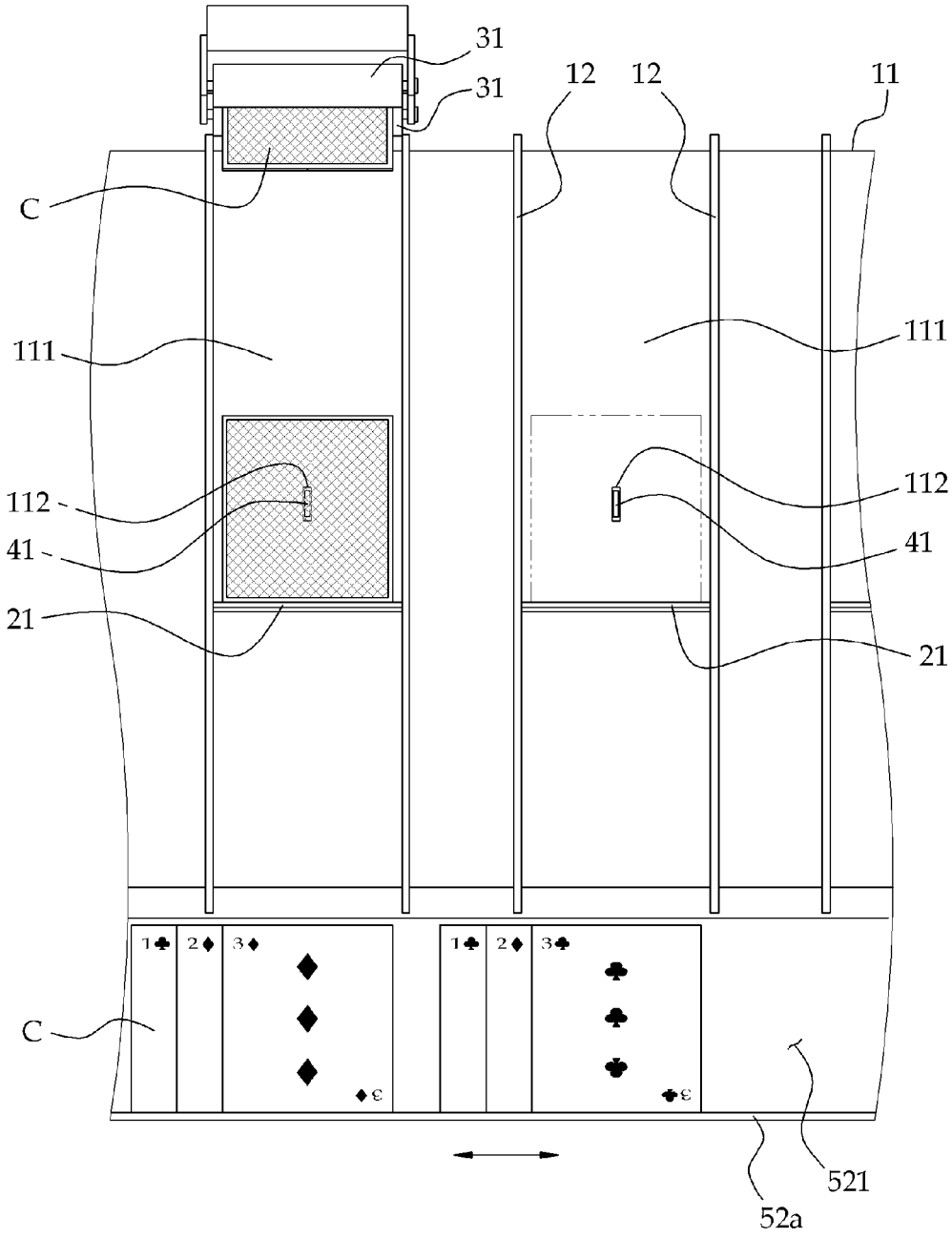
FIG. 5 is a partial front view of a card slide housing of another embodiment of a card game machine according to the present invention.

In the present embodiment, the card receive unit have the card receiving housings and the moving means 52 and each of the card receiving housings has the card receiving part. However, it is possible that the card receive unit have a card receiving and moving means as shown in FIG. 5.

The card receiving and moving means 52*a* is horizontally movable and has an integrated card receiving part 521. The integrated card receiving part 521 can be formed by integrating the card receiving parts 511. Cards C sliding down each of the slides 111 received by the integrated card receiving part 521 and supported by the inner surfaces of the integrated card receiving part 521.

The card receiving and moving means 52*a* in which the integrated card receiving part 521 is foamed is installed horizontally movable, so that at least a portion of the distinctive information of each of the cards C received in the integrated card receiving part 521 is recognizable as shown in FIG. 4. In the embodiment in FIG. 4, received cards from each slide are separated by physical walls from received cards of neighboring slide. But in this embodiment, received cards of each of the slides are not separated by physical walls (for example, the card receiving housing in FIG. 4) from received cards of neighboring slide.

In this embodiment, the card collect member 60 moves relative to the card receiving and moving means 52*a* and there is no obstacle such as the card receiving housings.

Figure 6:
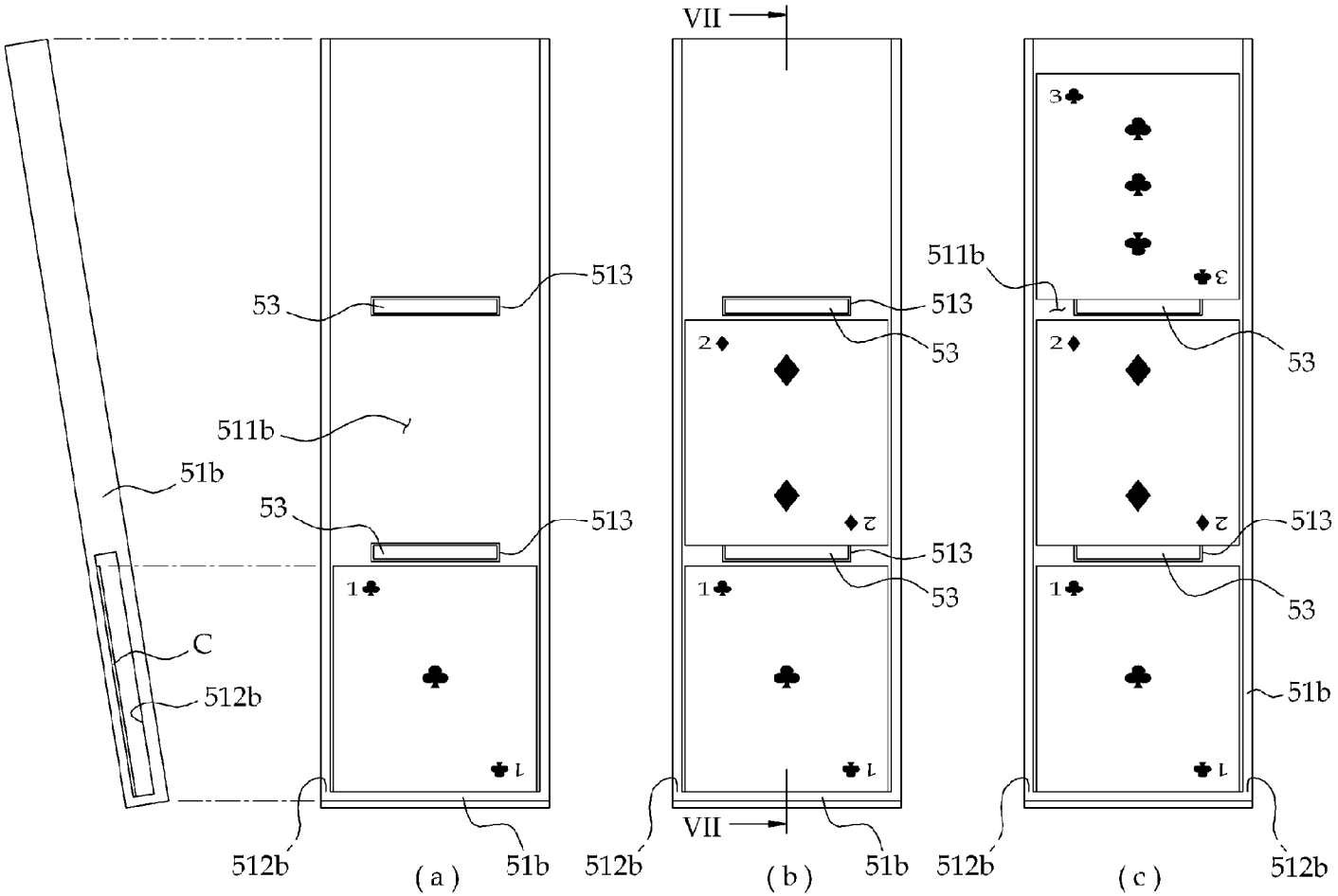
FIG. 6 illustrates a card receive unit of another embodiment of a card game machine according to the present invention in which cards are separated apart from each other to reveal the distinctive surfaces of the cards.
Figure 7:
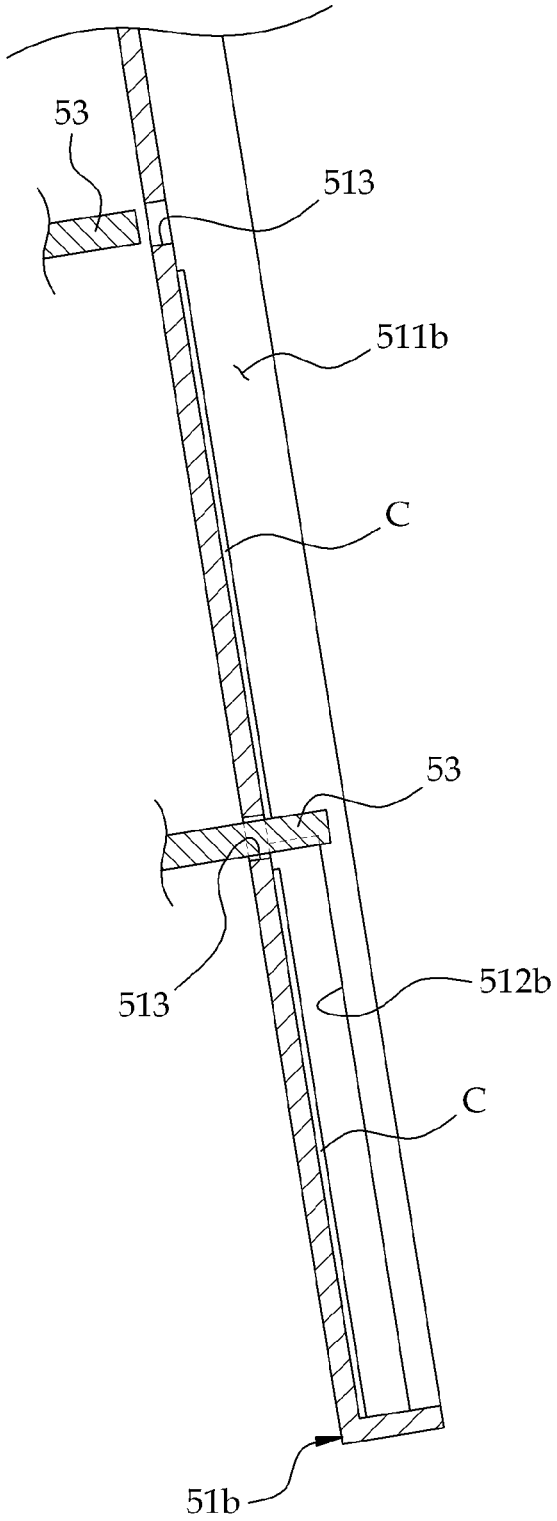
FIG. 7 is a cross-sectional diagram along line VII-VII of FIG. 6.
Figure 8:
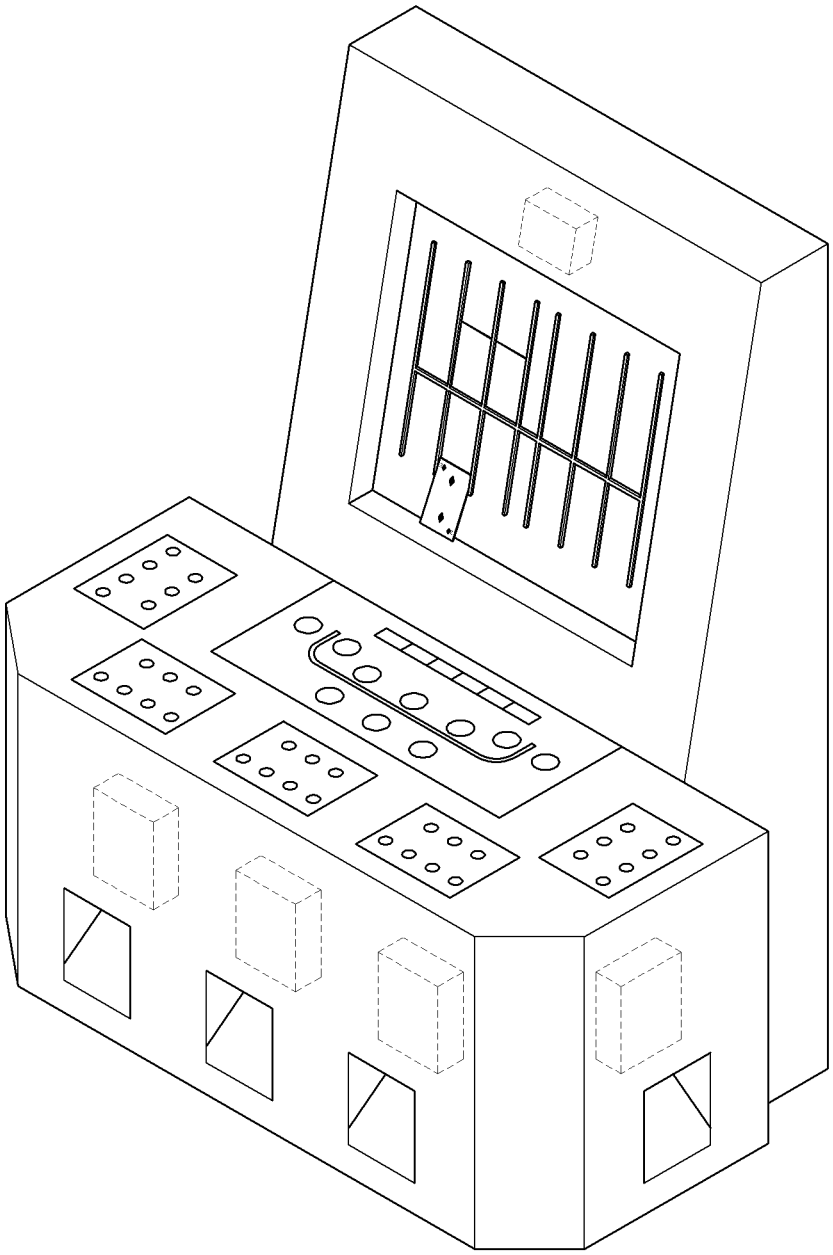
FIG. 8 is a perspective view of a prior art of a card game machine.

In the meantime, while the moving means of above embodiments are configured to move horizontally, moving means can be configured to move vertically as shown in FIG. 6.

In this embodiment, a card receive unit has plural card receiving housings 51*b* and card supporters 53.

Each card receiving housing 51*b* has a card receiving part 511*b* similar to the card receiving housing 51 of the preceding embodiment except that the width of the card receiving housing 51*b* is narrower than the card receiving housing 51 of the preceding embodiment. Each card receiving housing 51*b* is disposed apart from each other in the horizontal direction at regular intervals. Plural through holes 513 are formed apart from each other in the vertical direction in each of card receiving housings.

Multiple card supporters 53 are installed at each card receiving housing 51*b*. The card supporters 53 are installed to go through each of the through holes 513. Each of the card supporters 53 can alternate between an extruding position and a recessing position. When the card supporter 53 is at the extruding position, at least a part of the card supporter 53 extrudes through the through holes 513, so that a card C which has been flipped over by the card reversing member and starts sliding down the slide to the inner surface of the card receiving part 511*b* is stopped by the card supporter 53 before the card C reaches the inner surface of the card receiving part 511*b*. When the card supporter 53 is at the recessing position, the card supporter 53 do not extrude through the through holes 513 at all, so that a card C which has been flipped over by the card reversing member and starts sliding down the slide to the inner side of the card receiving part 511*b* can reach the inner surface of the card receiving part 511*b* without contact with the card supporters 53.

In this embodiment, when the card game machine is operated as below, the cards are separated from each other vertically, so that distinctive information of each of the cards is always recognizable as shown in FIG. 6.

In the initial state, each card supporter 53 is positioned at the recessing position. In this state, a card C slides down without contact with each of the card supporters 53 and reaches the inner side of the card receiving part 51*b* which defines the card receiving part 511*b*. Thereafter, when the bottommost card supporter 53 in the card receiving housing 51*b* is positioned at the extruding position to hold the second card, and the second card is distributed to slide down toward the card receiving part 511*b*, the bottom side of the second card contacts with the bottommost card supporter 53 and is stopped by the bottommost card supporter 53. Thus, the first card and the second card are separated from each other vertically, and the distinctive surfaces of the first card and the second card are entirely visible. Furthermore, the third card can be received by the same procedure except that the card supporter 53 just above the bottommost card supporter 53 is positioned at the extruding position. In this way, cards can be separated vertically for distinctive information of a plurality of cards to be recognizable.

And in this embodiment, when cards are needed to be collected, all of the card supporters 53 are to be positioned at recessing position before the card collect member 60 moves through entrance holes 512*b*.

Hereinafter, a process of playing card games in a remote site is described referring to FIGS. 9 to 13.

Figure 9:
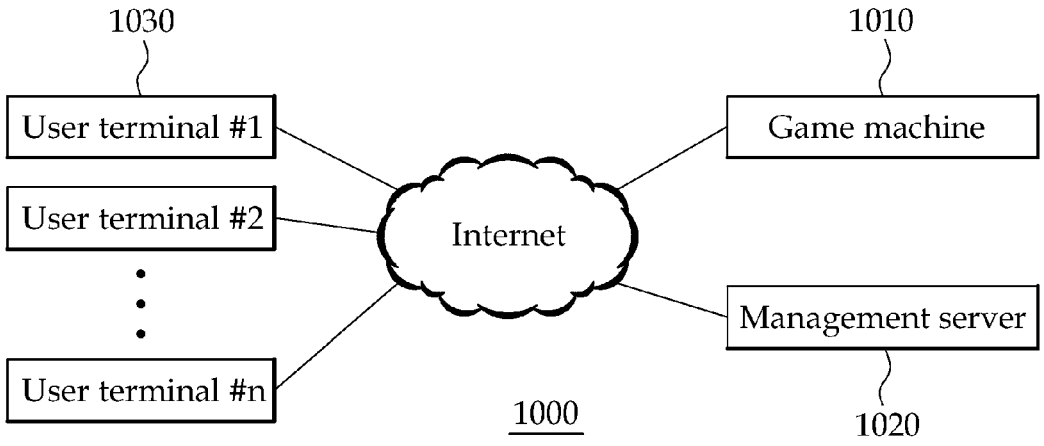
FIG. 9 shows configuration of a remote game system according to the present invention.

FIG. 9 shows a configuration of a remote game system 1000 according to the present invention.

As shown in FIG. 9, the remote game system 1000 includes a game machine 1010 performing above described operations, and a management server 1020 broadcasting the operations of the game machine 1010 to remote players live in real time, and a plurality of user terminals 1030 for the remote players to participate in games.

In FIG. 9, the game machine 1010, the management server 1020 and the user terminals 1030 are interconnected through the internet. The game machine 1010 and the management server 1020 can be directly connected for maintenance and management.

The game machine 1010 is an automated machine to play specific games such as Roulette, Baccarat, Dice, Blackjack etc. The game machine 1010 runs a game automatically according to each game rule and perform game operation according to commands from remote players.

The management server 1020 broadcasts the current state of a game to remote players and sends the game commands of the remote players to the game machine 1010. The management server 1020 transmits operating images of the game machine 1010 to the user terminals 1030 live in real time and sends the game commands from the user terminals 1030 to the game machine.

The user terminals 1030 show the operating images of the game machine 1010 on displays of the user terminals 1030. Remote players participate in a game by inputting game commands as they see the operating images of the game machine on displays of the user terminals 1030.

Figure 10:
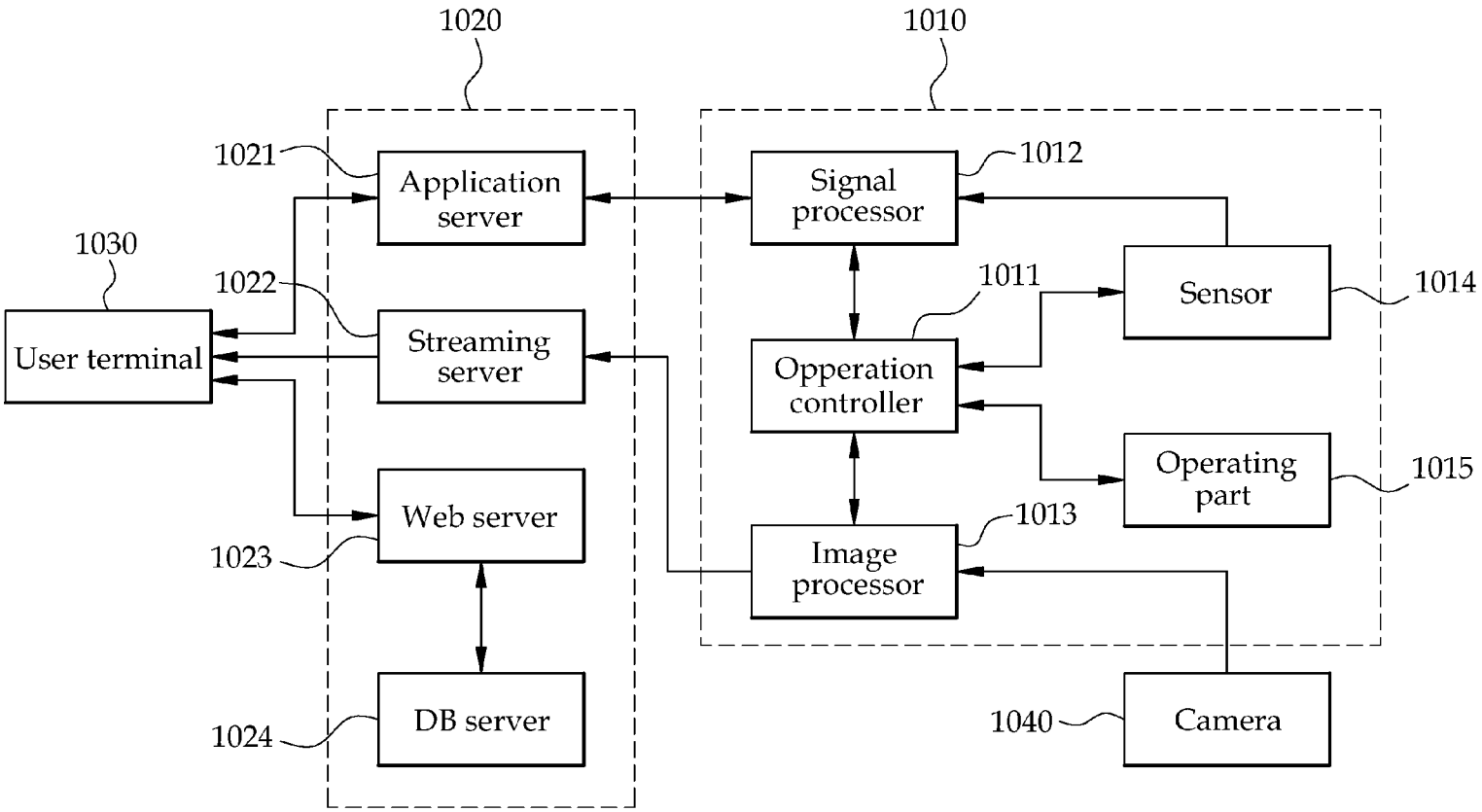
FIG. 10 shows configurations of a game machine and a management server.

FIG. 10 shows configurations of a game machine 1010 and a management server 1020 of the remote game system 1000.

As shown in FIG. 10, the game machine 1010 has an operation controller 1011 to control the operation of the game machine 1010, a signal processor 1012 receiving and processing information regarding operation of the game machine 1010 and transmitting an processed information to an application server 1021, an image processor 1013 processing video images of game machine 100 taken by an external camera 1040 and transmitting the processed video images to a streaming server 1022, a sensor 1014 sensing the distinctive information of game tools (for example cards, balls, dices etc.) and a operating part 1015 consisting of several mechanisms to perform motions of the game machine 1010.

The operation controller 1011 controls the whole operations of the game machine 1010. The operation controller 1011 drives the operating part 1015 according to a rule of a specific game and controls motions of the mechanisms of the game machine 1010.

The signal processor 1012 receives the operating information of the game machine 1010 from the operation controller 1011 and produces operation state signals. In the meantime, the signal processor 1012 receives the images of the game tools and produces an image recognition signal including the distinctive information of the game tool (a suit of a card, a number on a dice, a number on a ball) used in the games. The signal processor 1012 transmits the operation state signal and the image recognition signal to the application server 1021 during operation of the game machine.

Moreover, the signal processor 1012 receives and processes the game commands input through the user terminals 1030 and transmits the game commands to the operation controller 1011. The operation controller 1011 controls the operating part 1015 according to the game commands.

The camera 1040 is installed about game machine 100 to take the video images of the game machine in operation and the image processor 1013 processes the video images from the camera 1040 and transmits the processed video images to the streaming server 1022.

The sensor 1014 senses the game tools used in game machine 1010 and takes the distinctive information images of the game tools for image recognition of the game tools. The distinctive information images of the game tools taken by the sensor 1014 is input to the signal processor 1012 and the signal processor 1012 processes the distinctive information images of the game tools and produces the image recognition signal.

The operating part 1015 is a part performing motions such as distributing cards, rolling a dice. The operating part 1015 performs specific game motions according to the command of the operation controller 1011.

As shown in FIG. 10, the management server 1020 has the application server 1021 managing the process at the user terminals 1030 based on the operation state of the game machine 1010, the streaming server 1022 receiving the video images from the game machine 1010 and transmitting the video images to the user terminals 1030 live in real time, a web server 1023 providing functions related to games played on the web, and a database server 1024 storing various data.

The application server 1021 receives the operation state signal of the game machine 1010 and the image recognition signal from the signal processor 1012, and enables players to play a game at the user terminals 1030. And the application server 1021 receives various game commands input through the user terminals 1030 and transmits the various game commands to the game machine 100.

The streaming server 1022 receives the video images of the game machine from the image processor 1013 and transmits the video images to the user terminals 1030 in a streaming fashion. The user terminals 1030 display the video images of the game machine 1010 transmitted from the streaming server 1022 live in real time.

The web server 1023 provides the necessary functions for the players to play the games. When the user terminals 1030 are connected to the web server 1023, the players can register, log-in, cost paying, download game software, and reserve a game etc. by the user terminals 1030.

The database server 1024 stores various information such as user information, log-in information, transaction information, game software information, and web page information. When the user terminals 1030 are connected with the game server, the web server 1023 transmits the information to of the database server 1024 to the user terminals 1030 and transmits the data from the user terminals 1030 to the database server 1024.

The user terminals 1030 are personal computers or notebooks equipped by remote player to play games. The players need to download the game software from the web server 1023 and install the game software to the user terminals 1030. By means of operation of the software, the user terminals 1030 process the game, exchanging the date with the application server 1021.

The user terminals 1030 receive the video images of the game machine 1010 from the streaming server 1022, and receive operation state signals of the game machine 1010 and the image recognizing information related to the game tools from the application server 1021, and display the video images of the game machine 100 live in real time, and display the state of game progress and graphical images of the game tools recognized by the signal processor 1012.

Figure 11:
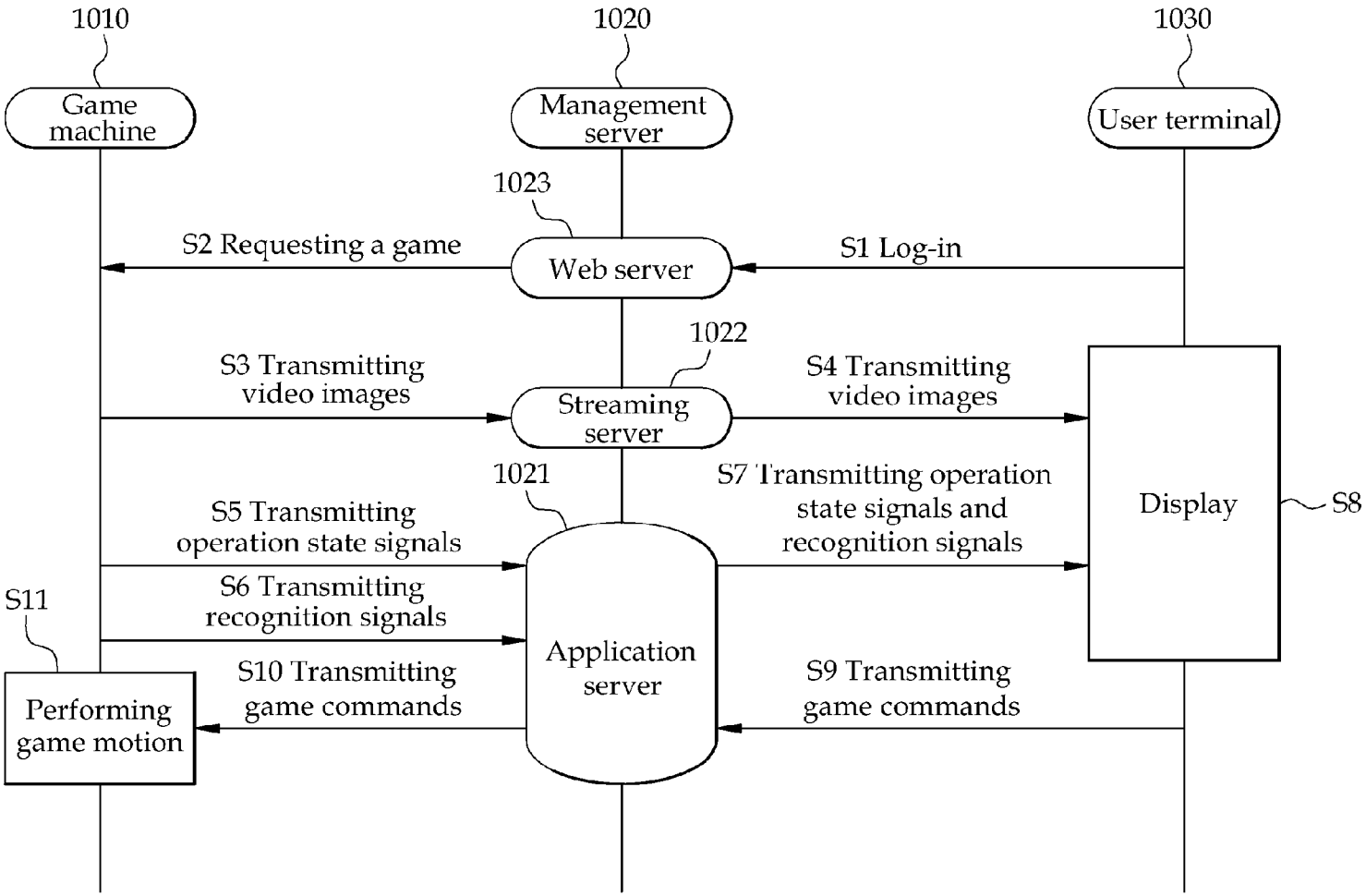
FIG. 11 shows a signal flow of a remote game system according to the present invention.

FIG. 11 shows a signal flow of a remote game system according to the present invention.

As shown in FIG. 11, firstly, the user terminal 1030 is connected with web server 1023 by log-in (S1). When the user terminal 1030 requests for a specific game, the web server 1020 requests a game from a game machine 1010 for playing the requested game (S2).

The game machine 1010 requested the game from the web server 1023 transmits the operating video images of the game machine 1010 to the streaming server 1022 (S3). When the streaming server 1022 receives the video images of the game machine 1010 from game machine, the streaming server 1022 transmits the video images to the user terminal 1030 in a streaming fashion (S4).

And the game machine 1010 transmits the operation state signal representing the operation state of the game machine 1010 and the image recognition signal including the distinctive information of the game tools to the application server 1021 (S5, S6). After receiving the operation state signal and the image recognition signal from the game machine 1010, the application server 1021 processes the operation state signal and the image recognition signal and transmits them to the user terminal 1030 (S7).

The user terminal 1030 receives the video images of the game machine 1010 from the streaming server 1022, and receives the operation state signal of the game machine 1010 and the distinctive information related to the game tools from the application server 1021, and displays the game images on the monitor (S8). The user terminal 1030 displays the video images of the game machine 1010 live in real time, and display the graphical images of recognized game tools at the same time.

The progress of the game can be known by the game images displayed on the monitor. The game commands input with a keyboard or a mouse at proper timing are transmitted to the application server 1021 (S9). When the application server 1021 receives the game commands from the user terminal 1030, the application server 1021 transmits the game commands to the game machine 1010 (S10).

When the application server 1021 receives the game commands from the application server 1021, the game machine 1010 performs the game operations in accordance with the commands (S11). As the game machine 1010 performs the game operations, the operation state of the game machine 1010 and the distinctive information of the game tools are transmitted through the application server 1021 to the user terminal 1030. During the game, the steps S3 to S11 are operated repetitively.

The game process in the remote game system 1000 according to this invention will be described. Blackjack will be used as an example to describe the game process more specifically.

Blackjack is a card game using card (trump). A player who brings total value of the cards closer to 21 than a dealer wins the game. At the beginning of each round, single cards are dealt to each of players clockwise from the dealer's leftmost position, followed by a single card to the dealer, followed by an additional card to each of the positions in play. So the dealer and the players are dealt initial two cards. On their turn, the players can choose whether to take a card (Hit), to end their turn without taking a card (stand). The players try to create card totals which will turn out to be higher than the dealer's hand, but without exceeding 21. Each player places their bets against the dealer. Each player wins their bets if its hand is higher than the dealer's.

When Blackjack is played in the remote game system 1000 of this invention, the game machine is corresponding to a dealer and the user terminal to a player.

Figure 12:
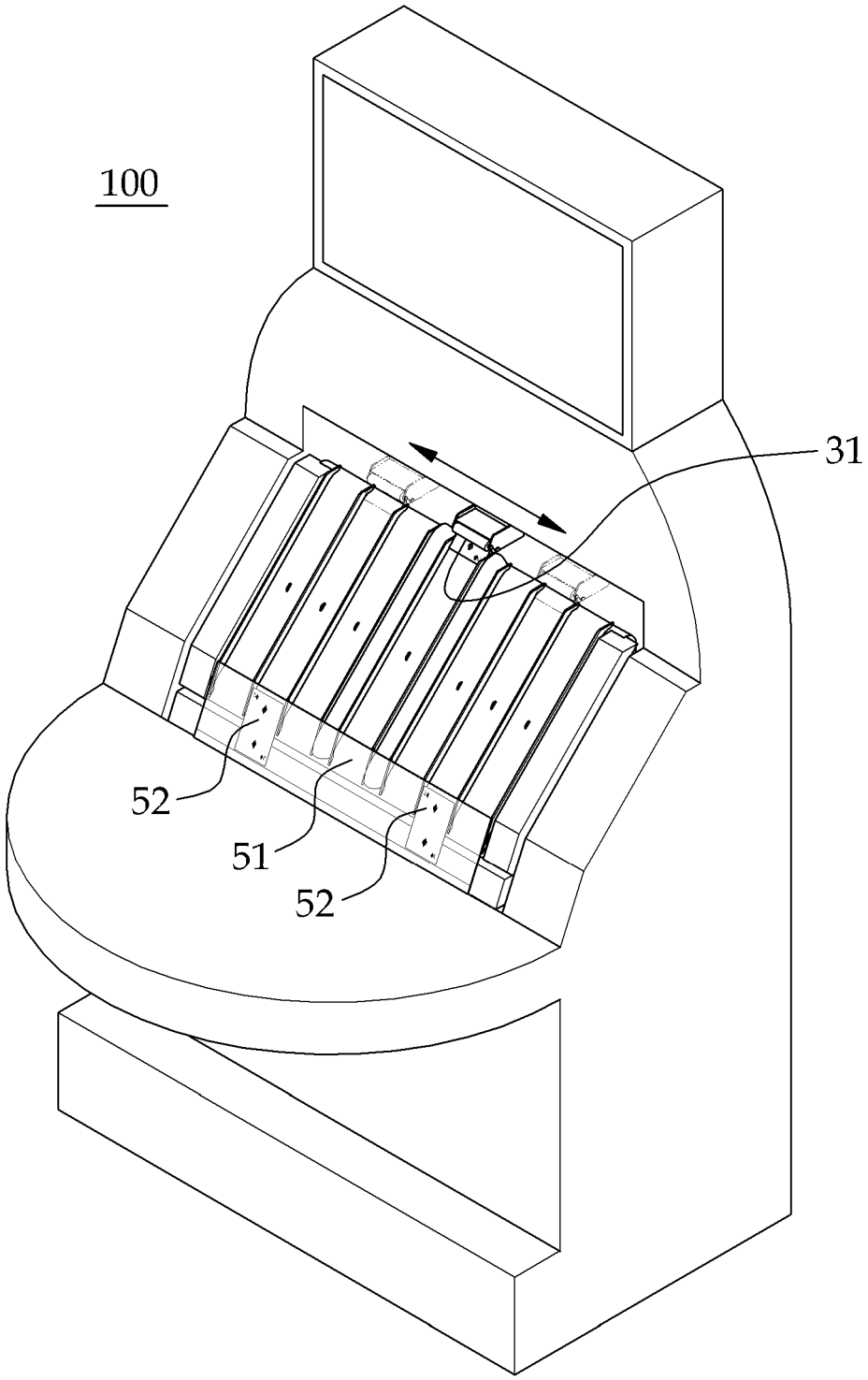
FIG. 12 shows a Blackjack game machine.

FIG. 12 shows a Blackjack game machine 100.

As shown in FIG. 12, the Blackjack game machine 100 has a dealer card receive part 51, a player card receive part 52 and a card distributor 31. The card distributor distributes the cards to the dealer card receive part 51 or the player card receive part 52, moving horizontal direction in accordance with game rules and game commands. In this way, the Blackjack game machine 100 automatically distributes the cards to the dealer and the players respectively.

The video images of the game operation of the Blackjack game machine 100 are transmitted to the user terminal 1030 live in real time. The user terminal 1030 displays the video images of the game operation of the Blackjack game machine 100 on the monitor. The remote player seeing the monitor can enjoy Blackjack.

Figure 13:
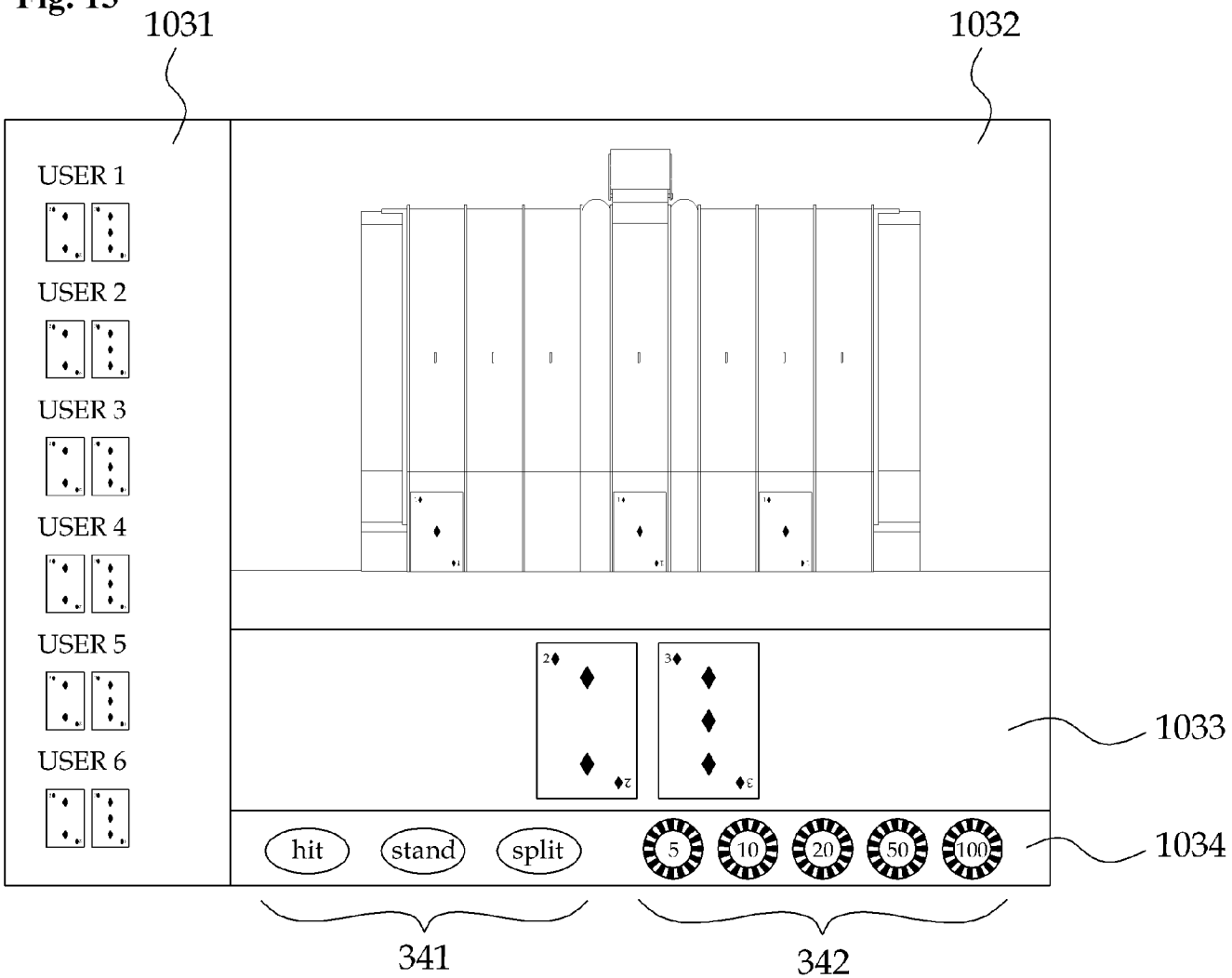
FIG. 13 shows a screen of Blackjack game.

FIG. 13 shows a screen of Blackjack game displayed on the user terminal 1030.

As shown in FIG. 13, the screen of Blackjack game is divided into a first region 1031 showing the status of the player, a second region 1032 showing the video images of the Blackjack game machine 100 in operation, a third region 1033 showing the graphical images of cards being used in the Blackjack game machine 100 and a fourth region 1034 showing icons and buttons relating to game commands.

In the first region 1031, the number of players, IDs of players and the graphical images of the cards of each player are shown. In the second region 1032, the operation state of the Blackjack game machine 100 is shown live in real time. The players can see the Blackjack game machine 100 distributing the cards to the dealer and the players on the second region 1032. In other words, the players can see cards from the card distributor 53 going into the dealer card receive part 51 or the player card receive part 52.

The graphical images of cards received by dealer card receive part 51 or the player card receive part 52 are shown in third region 1033 as described above. In the third region 1033, the received cards images are shown graphically. The player can identify his cards and dealer's cards by seeing the graphical images of cards shown in the third region 1033.

In FIG. 13, the graphical images of recognized cards are shown in the third region 1033. But the graphical images of recognized cards can be shown in the second region 1032 with the video images of the Blackjack game machine. The graphical images of recognized cards of the dealer can be shown in the second region 1032 with the video images of the Blackjack game machine and the image recognized cards of the player can be shown in the third region 1033, or the graphical images of recognized cards of the dealer and the player can be shown in the second region 1032 without the third region 1033.

In the fourth region 1034, the buttons and icons for game commands inputting is shown. The players can control the Blackjack game machine 100 by pushing the buttons 341 and bet by pushing or dragging the coin icons 342.

When the player pushes the hit button, the Blackjack game machine 100 deals another card to the player. When player pushes the stand button, the Blackjack game machine 100 deals no more cards. When player pushes the split button, the Blackjack game machine 100 draws a further card on each split card.

While certain preferred embodiments of the present invention have been described hereinabove, the present invention shall not be limited thereto. It will be apparent to those skilled in the art that various changes and modifications may be made without departing from the scope of the invention defined in the claims.

The invention claimed is:

1. A card game machine for playing a card game with a plurality of cards, each of which has a distinctive surface and a non-distinctive surface, the card game machine comprising:

a card slide housing having a plurality of slides, each of which is inclined with respect to the vertical direction such that cards can slide down each of the slides, and which are separated from each other;

a card stop unit which is coupled to the card slide housing to stop cards from sliding down each of the slides at a predetermined position;

a card distribute unit configured to distribute cards onto each of the slides;

a card drive unit configured to cause the cards that have been stopped by the card stop unit to start sliding again down the slides on which they have stopped; and a card receive unit which is arranged below the card stop unit and which has a plurality of card receiving parts corresponding to the respective slides to receive the plurality of cards which have slid down the respective slides, wherein the plurality of card receiving parts are movable such that distinctive portions of the distinctive surfaces of the cards received in each receiving part are spaced apart from each other in a direction.

2. The card game machine of claim 1, wherein the card receive unit has a plurality of card receiving housings in each of which card receiving part is formed, wherein the plurality of card receiving housings are movable in the horizontal direction such that distinctive portions of the distinctive surfaces of the cards received in each receiving part are spaced apart from each other in horizontal direction.

3. The card game machine of claim 2, wherein the plurality of card receiving parts are connected to form an integrated card receiving part.

4. The card game machine of claim 2, wherein the card stop unit has a plurality of stoppers each of which protrudes from each slide to support the cards, wherein the card distribute unit distributes each of the cards stacked in a cassette onto the slides, wherein the card drive unit has a card reversing member which is configured to move forward and backward with respect to the slide and to apply a force to flip over the card supported by the stopper.

5. The card game machine of claim 1, wherein the plurality of card receiving parts are connected to form an integrated card receiving part.

6. The card game machine of claim 1, wherein the card stop unit has a plurality of stoppers each of which protrude from each slide to support the cards, wherein the card distribute unit is configured to distribute each of the cards stacked in a cassette onto the slides, wherein the card drive unit has a card reversing member which is configured to move forward and backward with respect to the slide and to apply a force to flip over the card supported by the stopper.

7. A card game machine for playing a card game with a plurality of cards, each of which has a distinctive surface and a non-distinctive surface, the card game machine comprising:

a card slide housing having a plurality of slides, each of which is inclined with respect to the vertical direction such that cards can slide down each of the slides, and which are separated from each other;

a card stop unit which is coupled to the card slide housing to stop cards from sliding down each of the slides at a predetermined position;

a card distribute unit configured to distribute cards onto each of the slides;

a card drive unit configured to cause the cards that have been stopped by the card stop unit to start sliding again down the slides on which they have stopped; and a card receive unit which has a plurality of card receiving housings in each of which a plurality of card receiving parts to receive the plurality of cards which have slid down the respective slides are formed corresponding to the respective slides, and has a plurality of card supporters coupled to each of the card receiving housings, wherein the card supporters are spaced apart from each other in the vertical direction and are movable between an extruding position at which the plurality of cards sliding down the respective slides are supported by the card supporters and a recessing position at which the plurality of cards sliding down the respective slides are not supported by the card supporters.

8. The card game machine of claim 7, wherein the plurality of card receiving parts are connected to form an integrated card receiving part.

9. The card game machine of claim 7, wherein the card stop unit has a plurality of stoppers each of which protrude from each slide to support the cards, wherein the card distribute unit distributes each of the cards stacked in a cassette onto the slides, wherein the card drive unit has a card reversing member which is configured to move forward and backward with respect to the slide and to apply a force to flip over the card supported by the stopper.

* * * * *